United States Patent [19]

Smith et al.

[11] 3,932,858

[45] Jan. 13, 1976

[54] MASTER ANTENNA LINE COMMUNICATION SYSTEM

[75] Inventors: James O. Smith, San Jose; John J. Gade, Sunnyvale, both of Calif.

[73] Assignee: Inn-Tronics, San Jose, Calif.

[22] Filed: July 25, 1974

[21] Appl. No.: 491,656

Related U.S. Application Data

[63] Continuation of Ser. No. 330,598, Feb. 8, 1973, abandoned.

[52] U.S. Cl. ..... 340/280; 340/416; 340/408

[51] Int. Cl.[2] ..... G08B 13/14

[58] Field of Search ..... 340/280, 408, 413, 151, 340/152 T, 416, 167 A, 167 R, 216; 325/308; 179/15 BF, 15 AL, 175.3 F, 175.31 R

[56] References Cited

UNITED STATES PATENTS

| | | | |
|---|---|---|---|
| 3,482,243 | 12/1969 | Buchsbaum | 340/280 |
| 3,766,540 | 10/1973 | Schopfer et al. | 340/280 |
| 3,818,472 | 6/1974 | Mauk et al. | 340/280 |

*Primary Examiner*—Glen R. Swann, III

*Attorney, Agent, or Firm*—C. Michael Zimmerman, Esq.

[57] ABSTRACT

A theft communication system is particularly useful for indicating the unauthorized disconnection of a television set or the like from any one of the rooms of a hotel or motel. The communication system includes a central transmitter connected with a master television antenna system for transmitting successive querying scan pulses to sensors located on the antenna line at the location of each television set. Each of the sensors is adapted to apply a reply signal to the antenna line if its sensing circuitry indicates that its associated television set has been disconnected therefrom. The time of reply of each of the sensors is different from that of any other, and the system further includes a receiver connected to the antenna line at a central location for receipt of such reply signals. Such receiver is synchronized with the transmitter so that it can distinguish between reply signals from different ones of the sensors, and is adapted to generate an alarm signal if and only if a sensor replies to two successive querying signals, thereby making the generation of a false alarm due to the appearance of noise on the antenna line as a reply signal exceedingly unlikely.

5 Claims, 3 Drawing Figures

MASTER ANTENNA LINE COMMUNICATION SYSTEM

This is a continuation, of application Ser. No. 330,598, filed Feb. 8, 1973 and now abandoned.

BACKGROUND OF THE INVENTION

The present invention relates to a signal communication system and, more particularly, to such a system which is particularly useful for indicating at a central location, the unauthorized disconnection of an electrical appliance, such as a television set, at any one of a plurality of locations, such as from an outlet in one of the rooms of a hotel or motel.

The theft of television sets and the like from hotel and motel rooms is becoming increasingly common. Because such thefts represent substantial financial losses for the owners of such establishments, many different apparatuses and arrangements have been developed in an attempt to prevent such thefts. For example, some hotel and motel owners utilize mechanical arrangements which physically secure the television set at its room location in a manner which either prevents or inhibits removal. Most of such physical arrangements, however, are not satisfactory because they generally restrict the location from which programs on the set are viewable and/or are often defeatable in the long span of time in which a potential thief has access to the same when the thief is a registered guest.

In view of the deficiencies of mechanical theft prevention devices, generally the art has turned to use of a signalling or communication system of one sort or another which provides a signal at a central location, such as in the manager's office, whenever a television set is disturbed or electrically disconnected from its location. The more effective of such systems have required, however, that separate wiring be installed to each of the television locations, i.e., to each of the rooms of the hotel or motel. It will be appreciated that the expense of such an installation is major, especially if the system is to be installed in a hotel or motel which has previously been constructed. Attempts have been made to circumvent this expense by utilizing the existing electrical power distribution network of a hotel or the like as a communication link between the various television sets and a central location. The theft communication systems described in U.S. Pat. Nos. 3,411,150; 3,482,243, and 3,484,775 are examples of such systems. The use of electrical power lines for this purpose, however, has been found not to be satisfactory. For one thing, no such system has yet been developed which effectively prevents power surges or drains caused by the usual connection of various and sundry tools, appliances, etc., to the power line from adversely affecting the correct operation of the theft communication system. Moreover, the division of the power lines in the building into various circuits often restricts or prevents communication between certain locations. Such systems are also easily disabled without giving any clue to where a potential theft might take place, merely by interrupting the AC power.

SUMMARY OF THE INVENTION

The present invention provides a communication system capable of transmitting an alarm signal or the like from any one of a plurality of locations to a central location, without requiring the installation of special wiring or having to be subject to tie inaccuracies and deficiencies inherent in the use of an existing power line as a communication link. More particularly, the invention provides a system which utilizes a master antenna system, such as the master television antenna system found in hotels and motels to provide reception of a communication signal and distribution of the same to each of the rooms, as both a communication link and a power distribution network without interfering with or adversely affecting normal antenna reception.

In its basic aspects, the communication system of the invention includes a transmitting means for generating an information signal connected into an antenna system line for distribution of such signal by the antenna system to a plurality of locations, a sensor connected into the antenna system at each of such locations for receipt of the information signal, and separation means for preventing the information signal and any normal communication signal in the antenna system from interfering with one another. A power supply is also most desirably connected to the antenna system for the latter to convey power to the sensors for their operation.

Each of the sensors responds to the information signal by generating a reply information signal and applying it to the antenna line for conveyance to a receiver at a central location. The receiver includes means for distinguishing between signals from different ones of the sensors and indicating from which one it is receiving a signal. The communication system of the invention thus enables the plurality of locations to be checked to determine the condition of a state at each location, e.g., the presence or non-presence of a television set. If a predetermined state exists at the location, the receiver so indicates, specifyiny the location at which it exists.

The communication system of the invention also includes an arrangement which assures that neither noise nor a normal communication signal on the antenna line will cause a false alarm signal. More particularly, the receiver is adapted not to respond to any signal from a sensor indicating an alarm situation unless such signal is repeated by the same sensor. For this purpose, the receiver includes an appropriate memory and comparator for storing a first sensor signal indicating an alarm situation and comparing it with the next sensor signal which it receives. An alarm signal is given by the receiver only if the second sensor signal which it received corresponds to the first sensor signal. Thus, if noise on the line is responsible for what appears to be a sensor signal, the apparatus will not respond to it. The probability of two random noise signals appearing as sensor signals and occurring at successive times at which a sensor signal indicative of one given location is to be received by the receiver is statistically so remote as to be ignorable.

The invention includes other features and advantages which will become apparent from the following detailed description of a preferred embodiment.

BRIEF DESCRIPTION OF THE DRAWINGS

With reference to the accompanying three (3) sheets of drawings.

DETAILED DESCRIPTION OF A PREFERRED EMBODIMENT

Figure 1:
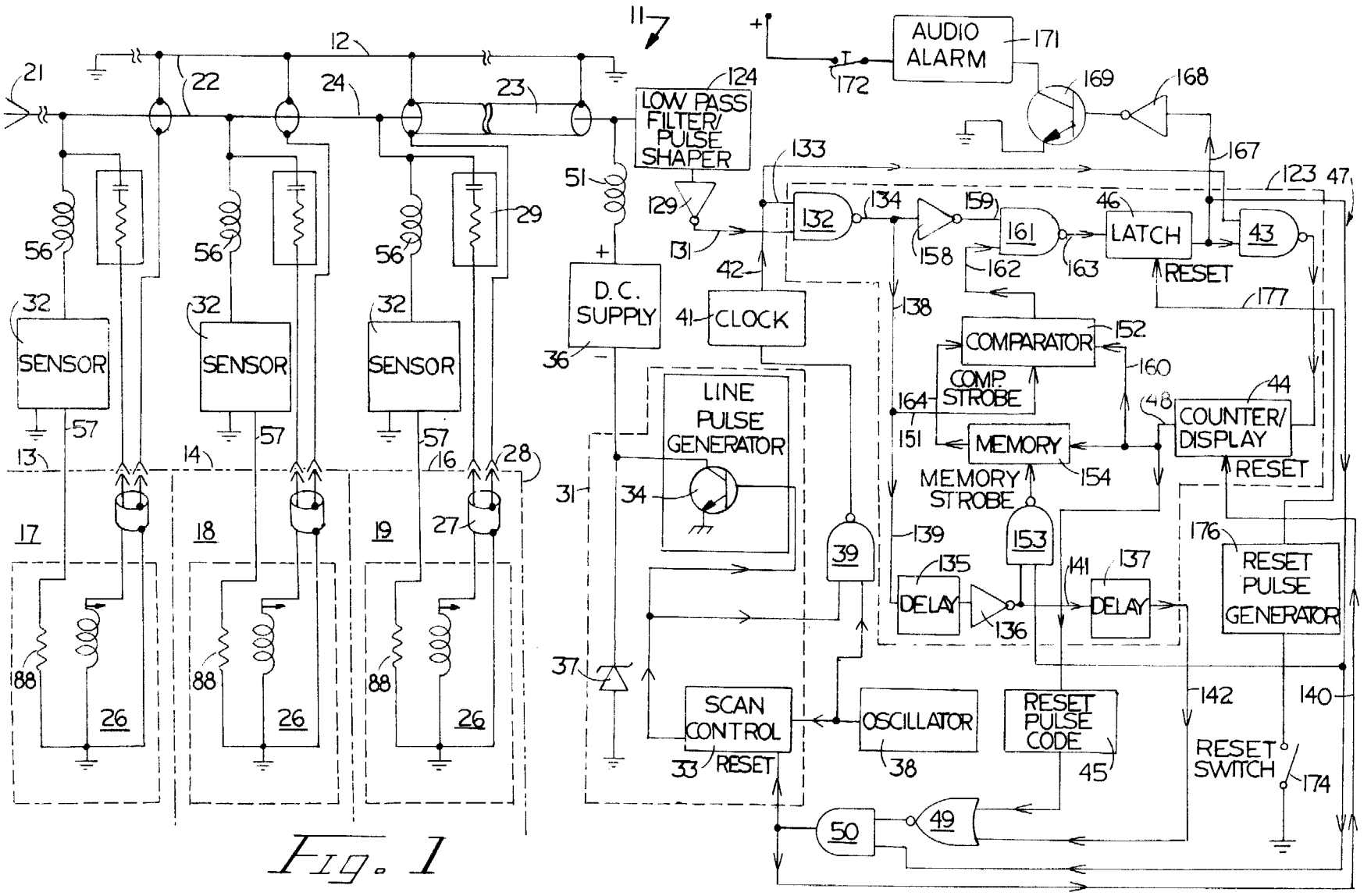
FIG. 1 is an electrical schematic and logic diagram of a preferred embodiment of the communication system of the invention.

With reference to the accompanying drawing, FIG. 1 is an electrical schematic and logic diagram of a preferred embodiment of the invention. More particularly, a theft communication system is generally referred to by the reference numeral 11 in FIG. 1 and includes a conventional master antenna system 12 of the type used in hotel and motels for picking up a communication signal, such as a television signal, and distributing it to a plurality of wall antenna outlets, such as represented at 13, 14 and 16, in individual rooms 17, 18 and 19. The antenna system 12 includes the usual antenna 21 for picking up a television signal, and an antenna distribution line 22 in the form of a coaxial cable having a grounded shield 23 surrounding a television signal line 24.

In this particular embodiment in which the communication system is for the purpose of detecting the disconnection of a television set from its room hook-up, each of the wall antenna outlets is a conventional wall plate of the type to which the antenna lead of a television set is normally connected. Such a television set is represented at 26 in each of the rooms 17–19. As illustrated, the tuner of each is connected by an antenna lead line 27 to the signal output socket 28 of its associated wall plate. Such socket 28 is connected through an RC isolation network 29, the purpose of which will be explained hereinafter, to the antenna distribution line 22.

The communication system of the invention further includes a transmitter for generating an information signal and distributing it over the antenna line to each of the wall antenna outlets. More particularly, the transmitter, generally referred to by the reference numeral 31, in FIG. 1, generates a querying scan pulse which is applied to the antenna distribution line 22 for distribution to a sensor 32 associated with each antenna signal output socket 28. To this end, the transmitter 31 includes a scan control 33 which is, in effect, a frequency divider which controls conduction of an npn transistor 34 providing a line pulse generator. As is illustrated, transistor 34 is connected between the negative terminal of a constant potential, d.c. power supply and ground. Such transistor is normally in the conducting state and thereby provides a connection between ground and the negative side of the power supply. When scan control 33 is activated, however, it will, after a prescribed time (the time desired between successive scans), bias the base of transistor 34 to the non-conducting state. When transistor 34 thus no longer provides a connection between the negative terminal of supply 36 and ground, such negative terminal is stepped upwardly by an amount equal to the voltage level set by zener diode 37 connected thereto. Such output terminal is maintained at the upwardly stepped voltage until such time as scan control 33 again biases the base of transistor 34 to the conducting state to provide a path to ground bypassing zener diode 37.

Means are also provided for timing the scan and automatically resetting the scan control to periodically terminate each scan and cause generation of the next succeeding scan. More particularly, an oscillator 38 which is preferably crystal controlled for accuracy is connected with the scan control 33 and, through a NAND gate 39, to a pulse clock 41 for synchronizing their operation. That is, when the outputs of both the scan control 33 and the oscillator 38 are at a high state, i.e., at each oscillation of the oscillator during a scan, the NAND gate 39 enables the clock 41 to generate positive clock pulses at its output 42. As will be described in more detail with respect to the receiver portion of the apparatus, the discrete locations at which a sensor is provided are represented by clock pulses. That is, each sensor (room) is represented by a clock pulse.

The first pulse from clock 41 is gated through NAND gate 43 to a counter/display unit 44. In this connection, latch 46 is normally ON, i.e., has a high state at its output terminal which high state is applied to gate 43 to normally enable such gate. The resulting output of NAND gate 43 will initiate counting by counter 44. A BCD output 48 of counter 44 is fed to a reset pulse code 45 which is set to generate a reset output pulse after the counter counts a predetermined number of clock pulses at least equal to the total number of sensors 32. Each scan will therefore be sufficiently long to enable each one of the different sensors to generate a reply information signal which is synchronized with an associated clock pulse occurring during each scan. Assuming, however, that no reply signal indicating the disconnection of a television set or the like has been received from any sensor during a count up to the BCD number to which the reset pulse coce is set, the reset pulse code will deliver an enabling pulse through one input of a dual input OR gate 49 to a dual input gate 50. The other input of gate 50 is connected to the normally high output of latch 46, with the result that when latch 46 is high, the delivery of the reset pulse to the gate 50 will cause the output of such gate to go high. Such scan control will respond thereto by saturating the base of transistor 34 to terminate the scan and initiate another scan after a prescribed delay. This operation will be continually repeated to generate successive scans until such time as a reply information signal is received from a sensor.

The successive square wave scan pulses emanating from the transmitter 31 are applied with the potential of power supply 36 to the antenna line 22 through means which protects the transmitter and the supply from any communication signals on such antenna line. More particularly, the positive output terminal of power supply 36 is connected through a radio frequency choke 51 to the antenna signal line 24. The purpose of power supply 36 is to provide a constant d.c. potential on the antenna line 22 to supply power for operation of the sensors 32 as will be described. The antenna line 22 is thus being used to provide power for the sensors and distribute the scan pulses thereto, as well as for picking up and conveying a normal television signal to each of the rooms.

FIG. 2A illustrates successive ones 52 of the scan pulses as added to the constant d.c. potential on line 24 caused by power supply 36. The period between each of the pulses 52 is determined by the delay built into the scan control between the time it terminates one scan pulse and the time it causes the next succeeding pulse to be initiated after receiving a reset pulse. FIGS. 2B and 2C respectively illustrate the clock pulse outputs 53 and counter inputs 54 corresponding to the scan pulses 52.

The potential level of supply 36 and the successively generated scan pulses 52 are distributed by the antenna line 22 to each of the sensors 32. As is illustrated, an rf choke 56 is interposed between each sensor and the antenna line 22 to protect the former from any communication signal on the antenna, while allowing the d.c. potential level and scan pulses to be received.

Each of the sensors 32 is adapted to not respond to the receipt of a scan pulse unless its connection via sensing line 57 and antenna lead line 27 is tampered with. In this connection, the sensors 32 are identical except for the characteristic time of each during a scan at which it will so respond.

Figure 3:
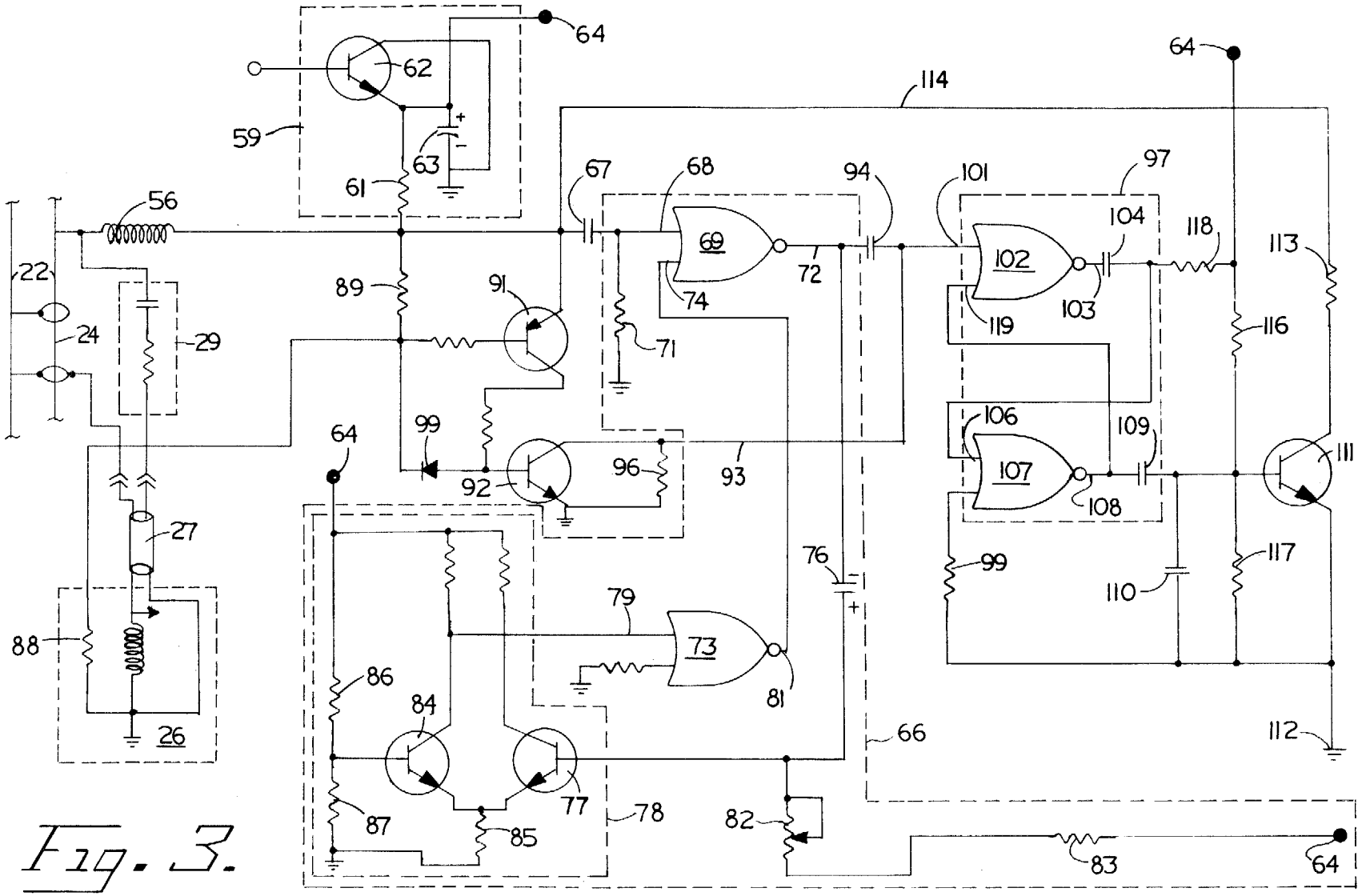
FIG. 3 is a schematic electrical diagram of a preferred sensor for use as a part of the system of FIG. 1.

FIG. 3 illustrates the details of one of the sensors 32. It includes power supply regulating means, as set off by dotted line 59 in FIG. 3, for receiving the d.c. power on the antenna line and regulating it to a constant voltage for powering such sensor. More particularly, the d.c. power on line 24 is applied through an isolation resistance 61 to the emitter of an npn transistor 62 of the power regulator. As illustrated, the base of such transistor is not connected, and its collector and emitter terminals are connected across a capacitance 63. Such capacitance is further connected between ground and the emitter of such transistor 62, with the result that the transistor 62 acts in the avalanche mode as, in effect, a temperature compensated zener diode. The desired constant voltage level for operating the sensor thus appears at terminal 64 irrespective of the presence of scan pulses on the incoming voltage.

Each sensor includes timing means for generating a reply signal a predetermined time after receipt thereby of a querying scan signal from the transmitter. Such timing means is, in essence, a monostable multivibrator, generally referred to by the reference numeral 66, having an rc time constant characteristic of the particular sensor. More particularly, a scan pulse received by the sensor from antenna line 22 is applied through an ac coupling capacitor 67 to a first input terminal 68 of a two input NOR gate 69 of the multivibrator. As illustrated, input terminal 68 is normally maintained at a low voltage level in view of it being tied to ground through resistance 71. However, the receipt of a scan pulse by the capacitance 67 will result in a positive spike being applied at gate terminal 68.

The appearance of a positive spike at input terminal 68 of NOR gate 69 will result in the output terminal 72 thereof going from a high to a low state. Such output is connected through another dual input NOR gate 73 to the second input terminal 74 of gate 69 in a manner which maintains such low condition at the output terminal 72 for a preselected time. That is, the low state at output terminal 72 of NOR gate 69 is coupled through a capacitance 76 to the base of a first npn transistor 77 of a flip-flop drive 78. As will be described in more detail hereinafter, when such low state is applied to the base of transistor 77, it renders such transistor non-conducting and causes the flip-flop drive 78 to impress a low state on input terminal 79 of the second NOR gate 73. The application of such low state to NOR gate input terminal 79 will result in a high state at the output terminal 81 of such NOR gate. As illustrated, such output terminal is connected to the input terminal 74 of gate 69, with the result that such high state will be impressed on the input terminal 74 to maintain the output of such gate at the low state.

A variable resistance 82 and a selected fixed value resistance 83 are also connected between the base of transistor 77 and the output potential 64 of power supply regulator 59. It is the rc time constant provided by the capacitance 76 and the resistances 82 and 83 which determines the delay time characteristic of the particular sensor. More particularly, after the low state of NOR gate terminal 72 is first applied through capacitance 76 to the base of transistor 77, such capacitance will charge at a rate dependent upon the *rc* time constant provided by such capacitance and the resistances 82 and 83. Such charging is caused by the higher potential on regulator terminal 64 being applied to such capacitance through the resistances 82 and 83 as illustrated. Upon the potential across such capacitance reaching the threshold level of the transistor 77, the base thereof will again be saturated to place such transistor in the conducting state. This will cause the flip-flop drive 78 to apply a high state on gate input terminal 79, with the result that a low state will appear at gate output terminal 81 and be impressed on the input terminal 74 of the first gate 69 to again cause its output terminal to go to a high state. It is this switch of the gate output terminal 72 from a low to a high state which initiates the sensor reply signal.

As mentioned previously, it is the characteristic time of reply of each sensor which is relied upon by the receiver of the system for distinguishing the reply of the sensor from that of another. It will therefore be appreciated that the particular time at which each sensor responds to a scan pulse with a reply signal must be carefully set and not allowed to drift to prevent confusion as to which sensor is replying and indicating that an alarm situation exists. For this reason, capacitance 76 and the resistances 82 and 83 should be carefully chosen for their temperature and time stability. In general, however, the threshold level of monostable multivibrators dependent upon now available C MOS dual input NOR gates tends to drift with time. C MOS gates, however, are especially suited for use with the present invention because of their low power requirements. It is for this reason that flipflop drive 78 is included as part of the sensor. Such flipflop drive will assure that the multivibrator initiates the reply pulse at the proper time irrespective of minor changes in the threshold level of the multivibrator. More particularly, the transistor 77 is connected in a push and pull arrangement with another similar npn transistor 84 between the operating potential of the sensor at regulator terminal 64, and ground through resistance 85. The value of resistances 86 and 87 are chosen to normally bias the base of transistor 84 to prevent current flow therethrough, whereas the base of transistor 77 is biased to normally maintain such transistor in the conducting state. However, as discussed above, upon a low state appearing at terminal 72 of NOR gate 69, the base of transistor 77 is brought to a sufficiently low state to prevent conduction through such transistor. Because of the common collector and emitter connection of the two transistors between operating potential terminal 64 and ground, transistor 84 will be made conducting at such time. Conduction through transistor 84 will result in the potential at input terminal 79 of gate 73 going low, causing a high state to be impressed on input terminal 74 of gate 69 to maintain the output of such gate low as described previously.

Upon the potential across capacitance 76 reaching the threshold level of transistor 77, such transistor will again be made non-conducting and the input terminal 79 of NOR gate 73 toggled to a high state. The resulting low state formed at the output terminal of such NOR gate 73 and applied to the input terminal 74 of NOR gate 69 will cause the output of such NOR gate to again go to its high state. As stated before, it is this change of the potential at terminal 72 from the low to high state which is the initiation of the reply signal.

It will be recognized from the above that the flipflop drive 78 toggles the input terminal 79 of NOR gate 73 from its low to high state in a much more positive manner than if such input terminal were directly connected to the change of potential across capacitance 76. In this connection, transistors are available for use as transistor 77 which have threshold levels that are much more time and temperature stable than those of presently available C MOS gates. Thus, minor variations in the threshold levels of gates 69 and 73 can be tolerated since they will not affect the timing of the generation of the reply signal.

The sensor further includes means for applying the reply signal to the antenna line 24 in response to the condition of a portion of its circuitry indicating that the sensing line 57 to a television set 26 has been disconnected or otherwise tampered with. If the sensing circuitry does not indicate that the sensing line 57 has been disconnected or otherwise tampered with, the reply signal as initiated at output terminal 72 of gate 69 is prevented from being applied to the antenna line for conveyance to the receiver. Such sensing circuitry will now be described. It first includes a resistance 88 which is installed within the television set between ground, e.g., the shield of antenna lead line 27, and the television sensing line 57. As illustrated, when the sensing line 57 and the antenna lead line are properly connected to the television set, resistance 88 acts with resistance 89 in the sensor as a divider to divide the voltage from antenna line 24 applied to the base of pnp transistor 91. The threshold level of transistor 91 is so chosen that when such divided potential is so applied to the base, the transistor is made conducting so as to convey current between line 24 and the base of npn transistor 92. The threshold level of the latter transistor is also chosen so that when transistor 91 is conducting, transistor 92 is also made to conduct. As illustrated, the collector of such transistor is connected via lead 93 to the output signal of gate 72 as it will appear across a capacitance 94. When transistor 92 thus provides a path to ground for such signal bypassing resistance 96, such output signal (the reply signal) will effectively be terminated at capacitance 94. The result is that the sensor is thus prevented from providing a reply to a scan pulse whenever the television set is properly plugged into the wall plate both via its sensing line 57 and antenna lead line 27.

When resistance 88 is not in the sensing circuit, i.e., when either the television set sensing line or the antenna lead line 27 is disconnected or shorted, the circuitry enables passage to the antenna line of the reply signal. More particularly, upon sensing line 57 being disconnected, for example, the normal connection to ground through resistance 88 is open, with the result that the potential on the base of transistor 91 increases through resistance 89 to a higher state determined by the voltage on antenna line 24. Such increase of potential on the base of transistor 91 will render the same non-conducting, with the result that current flow to the base of transistor 92 will be terminated. Because of such, the output signal generated at the output terminal 72 of NOR gate 69 shall cause the discharge rate of capacitance 94 to be controlled by the rc time constant of such capacitance 94 and a resistance 96. The capacitance 94 thus couples the reply signal to a pulse shaper, generally referred to by the reference numeral 97.

If resistance 88 is shorted out, rather than disconnected, such as if a shorting line is applied between the television sensing line and ground, the reply signal will also be allowed to flow to the pulse shaper 97. More particularly, if sensing line 57 is connected directly to ground, the cathode of a diode 99 will be effectively grounded, with the result that current flowing through transistor 91 will be diverted from the base of transistor 92. Thus, such transistor is rendered non-conducting, with the result as discussed above that the capacitance 94 passes the reply signal appearing at gate terminal 72 to the pulse shaper 97.

Pulse shaper 97 is basically a monostable multivibrator similar to that provided by NOR gates 69 and 73, except that its toggling rate is much faster. The input terminal 101 of dual input NOR gate 102 is normally maintained in a low state in view of its connection via line 93 and transistor 92 to ground. However upon transistor 92 being rendered non-conducting at the same time a reply signal appears across capacitance 94, such input terminal is toggled to a high state. The resulting low state at the output terminal 103 of NOR gate 102 is coupled through a capacitance 104 to an input terminal 106 of a second dual input NOR gate 107. The high state thus caused at output terminal 108 is coupled through a capacitance divider provided by capacitances 109 and 110 to the base of an npn transistor 111. The result is that transistor 111 is rendered conducting to provide a direct connection between ground as indicated at 112 and the antenna line 24 through resistance 113 and lead 114. The potential on such antenna is thus grounded, resulting in a negative spike, the reply signal, being applied to the antenna line. It will be noted that the base of transistor 111 is also connected through a voltage divider provided by resistances 116 and 117 to regulator terminal 64 to appropriately bias such base for its operation.

The duration of the reply pulse will depend upon the rc time constant of capacitance 104 and resistance 118. In this connection, when output terminal 108 of NOR gate 107 goes high, such high condition is transmitted to the second input terminal 119 of NOR gate 102, with the result that the output terminal 103 thereof is maintained in the low state. However, because of the connection of capacitance 104 through resistance 118 to the regulator terminal 64, upon NOR gate terminal 103 going low, such capacitance will be charged through resistance 118. When the potential drop across such capacitance reaches the threshold level of input terminal 106 of second NOR gate 107, the output terminal 108 thereof will again be made to go low. This will terminate the reply signal.

Figure 2:
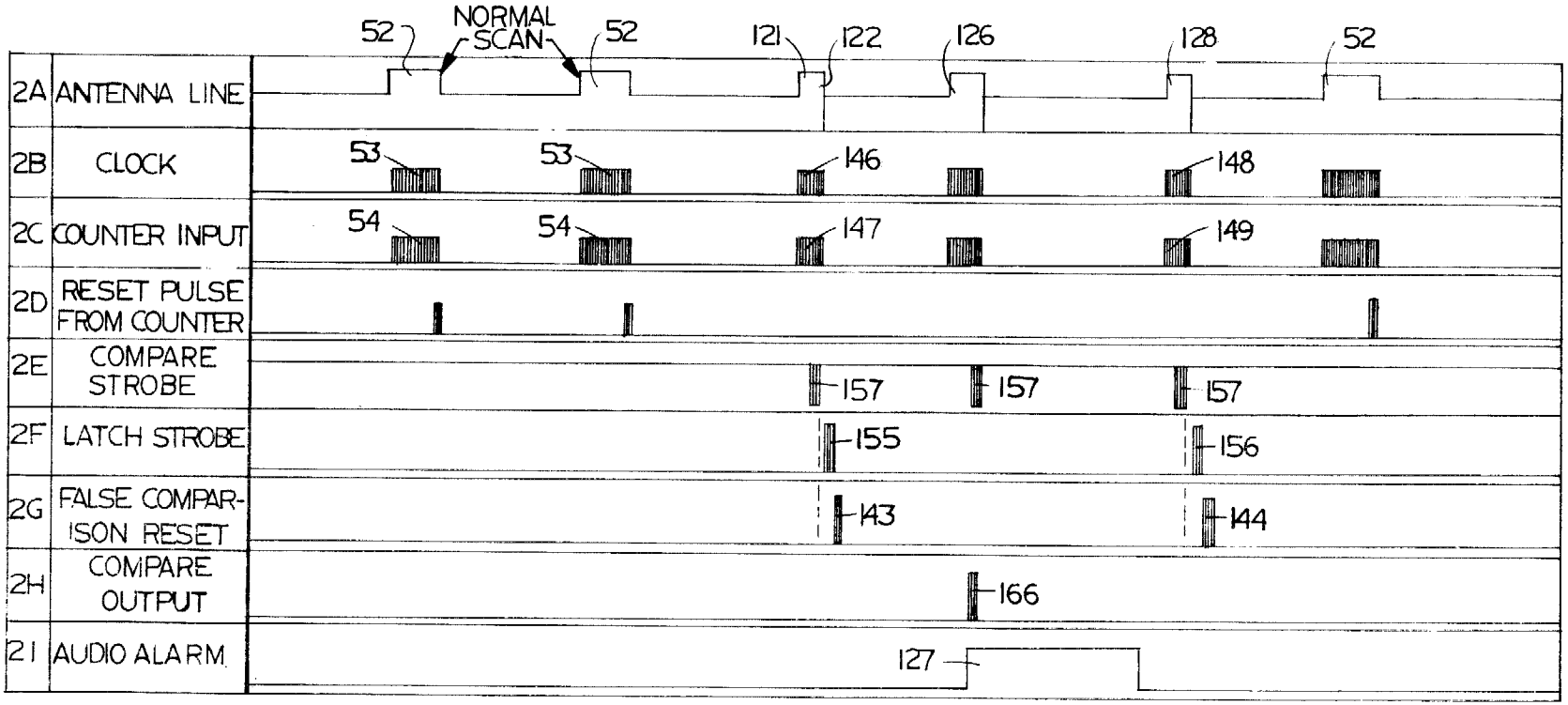
FIG. 2 sets forth in graph form a relative timing sequence for various ones of the signals generated by the communication system of FIG. 1.

With reference to FIG. 2, the negative reply pulse on the antenna line is represented in scan pulse 121 at 122. As discussed previously, the time at which the reply pulse appears during the duration of a scan pulse is different for each of the sensors. Such time of reply thus provides a mode of determining which sensor generated the same and, hence, from which room it emanates. For this purpose, the system of the invention includes a receiver 123 which is most conveniently connected with the transmitter as shown in FIG. 1. Any reply pulse on the antenna line 24 will be applied through a low pass filter/pulse shaper 124 to such receiver. Low pass filter/pulse shaper 124 not only isolates receiver 123 from any television signal on the antenna line, but also acts to reduce the passage of noise to such receiver. Receiver 123 further includes an additional safeguard to assure that noise does not cause the receiver to give false alarms. More particularly, such receiver is adapted to generate an alarm signal in response to receipt of a reply signal from any sensor if and only if such reply signal to a scan pulse is repeated in response to the next succeeding scan pulse. That is, again with reference to FIG. 2, two of the reply spikes 122 must be received by the sensor in successive scans 121 and 126 before an alarm signal, represented at 127 in FIG. 2I of the timing diagram, is generated. Thus, random noise pulses, such as pulse 128 in FIG. 2A, which may appear on the antenna line due to electrical apparatus in its vicinity will not cause an incorrect alarm to be given. Two of such random noise pulses would have to coincide at the exact time in successive scans before they could cause an alarm signal, an event which is statistically quite unlikely.

With reference to FIG. 1 again, all reply signals and any noise pulses on line 24 which pass through low pass filter/pulse shaper 124 will be applied through an inverter 129 to an input terminal 131 of a first NAND gate 132 in receiver 123. As illustrated, the other input terminal 133 of such NAND gate is connected directly with the output of clock 41. As discussed previously, the output of clock 41 during each scan pulse is a plurality of pulses. The characteristic time of reply of each of the sensors is corrolated in time with an associated one of the pulses in each scan. Clock 41 has a high duty cycle so that it will provide a relatively long time window associated with each sensor and within which a reply pulse from such sensor is receivable.

Upon a reply signal or noise pulse being applied to the gate input terminal 131 at the same time a clock pulse is applied to terminal 133, the output terminal 134 of the NAND gate 132 will be made to go low for the duration of the reply pulse. Such low condition is utilized for various purposes in the receiver. For one thing, it is conveyed through delay 135, inverter 136 and delay 137 by lines 138, 139, 141 and 142, and appears as a high state on one input of the dual input OR gate 49. When the output 47 of latch 46 is also high as it normally is, AND gate 50 will be caused to reset scan control 33 of the transmitter. The output of AND gate 50 is also directed at such time via line 140 to the counter/display 44 of the receiver to reset it as well.

The scan control will thus terminate the scan-pulse and initiate a succeeding one as previously described by appropriately biasing the base of transistor 34. This succeeding scan pulse is for the purpose of again querying the sensors to determine if the reply pulse will be repeated. FIG. 2G illustrates the delayed reset pulse for the scan control and counter/display at 143 in response to a true reply signal, and at 144 in response to a noise signal. The termination of the scan 121 upon receipt of a reply pulse 122 will be noted in FIG. 2A, as well as the termination of the scan by the noise pulse 128. It will be recognized that the resetting of the scan control and counter/display will also terminate the clock output and, hence, the counter input for the delay period built into the scan control. Such termination of the pulse train output of the clock and input to the counter is indicated respectively by pulse trains 146 and 147 of FIGS. 2B and 2C. The clock output and counter input pulse trains corresponding to receipt of a noise pulse are indicated at 148 and 149, respectively.

The low state at NAND gate output terminal 134 is also conveyed via line 138 and line 151 to strobe a comparator 152. Such comparator will only respond to the low strobe condition with a high output if such low condition represents a repeated reply signal from one of the sensors as will be described. Thus, assuming that the low condition fed to the comparator 152 is representative of a first reply signal from a sensor, such comparator will act as the termination of such low condition in the logic chain of which it is a part.

The low condition at gate output terminal 134 will also be fed via lines 138 and 139, delay 135 and inverter 136 to one input of a dual input AND gate 153 where it appears as a high state. The other input of gate 153 is connected to the output 47 of latch 46 so that when such output is high, the high condition on the first input of gate 153 will cause it to strobe a memory 154. Such memory, preferably of the latch type, is connected to the BCD output 48 of counter 44 so that such strobing of the memory causes the BCD number in the counter/display to be inserted into such memory. The insertion of a BCD number into the memory will reset or clear the memory of any other numbers previously inserted therein. It will be recognized that because of the delay 136, the strobing of the memory will occur after the comparison by comparator 152 so that the number present in the counter/display is not compared with itself.

The memory strobe pulse is represented in FIG. 2F at 155 for a first reply signal and at 156 for a noise pulse. The times at which comparisons are made by the comparator are represented by pulses 157 to indicate the delay between the comparisons and the memory pulses.

The low condition at output terminal 134 will also be inverted by inverter 158 and fed to a first input terminal 159 of a NAND gate 161. The other input terminal 162 of such NAND gate is fed by the comparator 152. Assuming again that the reply pulse which initiated the action in the receiver is the first reply pulse from the particular sensor with which it is associated since the memory 154 has been cleared, such NAND gate 161 will act as the termination of the reply pulse in the logic chain of which the NAND gate 161 is a part. That is, it is only when comparator 152 applies a positive output pulse on input 162 indicating a true comparison at the same time a positive pulse appears at input 159 that NAND gate 161 generates a negative pulse at its output.

If on the next scan the reply pulse from the particular sensor is repeated, such reply pulse will again be inverted by inverter 129 and gated into the receiver by NAND gate 132. The low condition at the output terminal 134 of the gate will be inverted by inverter 158 and applied as a high state at input 159 of NAND gate 161. It will also be directed via lines 138 and 151 to the comparator 152 to initiate a comparison. In this connection, the BCD output of the counter/display is continually fed to the comparator 152 via line 160. Memory 154 will deliver the BDC number stored therein to the comparator via line 164, and if at the time a comparison is made, the BCD number in the memory is the same as the number then at the BCD output of the counter/display 44, the comparator will react thereto by delivering a positive pulse, represented at 166 in FIG. 2H, to the input terminal 162 of NAND gate 161. Thus, when a reply signal from one particular sensor is repeated, both input terminals of the NAND gate will be brought to a high potential level at the same time, with the result that a low potential state appears at its output terminal 163.

The low potential state on the output of NAND gate 161 will toggle latch 46 to cause a low state at its output 47, with the result that the pulse train from the counter will not pass disabled NAND gate 43 to the counter 44. This will cause counter 44 to stop counting on the number of pulses representative of the time delay characteristic of the particular sensor responsible for the two succeeding reply pulses. Such count will also be displayed by the counter. Most desirably, the count represented by each sensor's reply signal is corollated with the number of the room in which the sensor is located so that the counter will display the number of the room in which the television set connection has been disturbed.

The low potential state of the output 47 of latch 46 will also be directed via line 167 and an inverter 168 to the base of an npn transistor 169 to cause it to conduct. Conduction of such transistor will complete a series circuit containing an audio alarm 171, with the result that such alarm will sound to call attention to the alarm situation. A manually operated switch 172 is provided in series with the audio signal to allow it to be disabled by an operator.

It should be noted that the low condition on latch output 47 also disables AND gate 50 so that neither the scan control nor the counter are reset for another scan whenever an alarm situation is indicated.

Means are provided for resetting the communication system once an operator has terminated the audio alarm and checked the room displayed by the counter 44. Such resetting is accomplished by the closing of one switch, a manually operated reset switch 174, to activate a reset pulse generator 176. Such pulse generator will direct a reset pulse on line 177 to latch 46 to again enable the same to allow pulses from clock 41 to reach counter 44. The resetting of latch 46 will simultaneously direct a reset pulse to AND gate 50 to cause resetting of the scan control and counter/display. The scan control will then again initiate a scan pulse after a predetermined time as previously discussed. Moreover, additional scan pulses will continue to be initiated as previously described until such time as another alarm situation is detected.

It will be seen from the above that by utilizing an existing antenna distribution system, the theft communication system of the invention provides a fool-proof way of detecting a television's theft without requiring special wiring between each theft sensor and the central location at which the theft is to be reported. The apparatus of the invention accomplishes this function without interfering with the normal function of the antenna. Moreover, the system of the invention includes means assuring that false alarms will not be generated by electrical noise or the like.

It will be recognized by those skilled in the art that although a preferred embodiment of the invention has been described, various changes and modifications can be made without departing from its spirit. For example, although the communication system is described in connection with detecting possible theft of a television receiver or the like, it will be recognized that it can be used to convey information relating to other matters, either in place of or in addition to the theft alarm described. Moreover, it is useable with antenna designed to pick-up other signals, such as radio signals. It will be recognized, though, that the means of separating the communication signal for which the antenna is intended from the information signals of the present invention will have to be appropriately modified. In view of these and other potential variations, it is intended that the coverage afforded applicants be limited only by the language of the claims and its equivalent.

We claim:

1. In combination with an antenna system having an antenna for receipt of a communication signal and a common antenna line connected between said antenna and a plurality of locations for common distribution of such communication signal to said plurality of locations; transmitting means for generating a querying information signal different from said communication signal directly connected into said antenna like for distribution of such information signal over said line to said plurality of locations; a plurality of sensors, each of which is connected to said antenna line at an associated one of said locations for receipt of said information signal and includes means responsive to receipt of said information signal by selectively generating and applying a reply information signal to said antenna line in response to a predetermined condition of the sensor circuitry; receiving means connected to said antenna line for generating an alarm signal in response to receipt within a selected time interval of a predetermined number of reply information signals from any one of said sensors; and means on said antenna line for preventing said information signal and any communication signal on said antenna line from interfering with one another; said transmitting means continually generating successive querying signals and distributing the same over said antenna line to said plurality of sensors, and said receiving means generating said alarm signal in response to receipt of a pair of reply signals spaced in time from one another an interval indicative of one of said sensors generating said reply signals in response to succeeding ones of said querying signals; each of said successive querying signals generated by said transmitting means being an electrical scan pulse having a predetermined time of initiation; each of said sensors including timing means adapted to apply a reply signal to said antenna line if said predetermined condition of said sensor circuitry exists at a predetermined time after receipt thereby of said scan pulse, which predetermined time is different for each of said sensors; said receiving means including means for distinguishing between reply pulses received from different ones of said sensors on the basis of the time at which said reply pulse is sent thereto after transmittal of an electrical scan pulse on said line; power supply regulating means for receiving electrical power on said antenna line and regulating the same to provide an essentially constant power level for operation of said sensor; and said timing means of each of said sensors including means providing a time constant for setting said time at which said sensor generates said reply signal after receiving said scan pulse signal, means for generating said reply signal after said predetermined time, and means responsive to the passage of said predetermined time as determined by said time constant means by causing said generating means to initiate said reply signal.

2. A communication system comprising transmitting means for generating a querying information signal, and a sensor responsive to receipt of said information signal by selectively generating a reply information signal, said sensor including timing means for sending said reply signal a predetermined time after said sensor receives said information signal; and wherein said timing means includes means providing a time constant for setting said predetermined time a mono-stable multivibrator for generating said reply signal after said predetermined time, and a flip-flop drive responsive to the passage of said predetermined time as determined by said time constant means by driving said multivibrator to initiate said reply pulse, whereby minor changes in the threshold level of said multivibrator do not affect the timing of said reply pulse.

3. The communication system of claim 2 wherein said sensor further includes power supply regulating means for receiving variable power input and regulating the same to provide an essentially constant power level for operation of said sensor.

4. The communication system of claim 2 wherein said communication system includes a plurality of sensors, each one of which is located at a different location for receipt of an information signal from said transmitting means, said sensors including timing means adapted to send a reply signal at a predetermined time after receipt thereby of an information signal from said transmitting means, which predetermined time is different for each of said sensors; and receiving means included as part of said communication system for receiving said reply signals, such receiving means including means for distinguishing between reply signals received from different ones of said sensors on the basis of the time at which said reply signal is sent thereto after transmission by said transmitting means of the information signal to which said reply signal is responsive; and wherein said transmitting means continually generates said information signals and said receiving means generates an alarm signal after receipt thereby within a selected time interval of a predetermined number of reply signals from any one of said sensors.

5. The communication system of claim 4 wherein said receiving means is adapted to generate said alarm signal in response to receipt thereby of a pair of reply signals spaced in time from one another an interval indicative of one of said sensors generating said reply signals in response to succeeding ones of said information signals.

* * * * *